US009051870B2

(12) United States Patent
Quix et al.

(10) Patent No.: US 9,051,870 B2
(45) Date of Patent: Jun. 9, 2015

(54) COOLANT CIRCUIT FOR INTERNAL COMBUSTION ENGINE WITH INLET-SIDE FLOW CONTROL

(71) Applicant: FORD GLOBAL TECHNOLOGIES, LLC, Dearborn, MI (US)

(72) Inventors: Hans Guenter Quix, Herzogenrath (DE); Jan Mehring, Köln (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 10 days.

(21) Appl. No.: 13/737,078

(22) Filed: Jan. 9, 2013

(65) Prior Publication Data

US 2013/0186351 A1 Jul. 25, 2013

(30) Foreign Application Priority Data

Jan. 19, 2012 (DE) ..... 10 2012 200 746

(51) Int. Cl.

| | |
|---|---|
| ***F01P 7/00*** | (2006.01) |
| ***F01P 5/10*** | (2006.01) |
| ***F01P 3/02*** | (2006.01) |
| ***F01P 7/16*** | (2006.01) |

(52) U.S. Cl.

CPC ... *F01P 5/10* (2013.01); *F01P 3/02* (2013.01); *F01P 7/165* (2013.01); *F01P 2003/027* (2013.01)

(58) Field of Classification Search

CPC ..... F01P 3/02; F01P 3/00; F01P 7/16; F01P 7/165; F01P 7/14; F01P 2003/028; F01P 2007/146; F01P 7/00; F01P 7/04; F01P 11/18

USPC ..... 123/41.02, 41.03, 41.05, 41.08, 41.07

See application file for complete search history.

(56) References Cited

U.S. PATENT DOCUMENTS

| | | | | |
|---|---|---|---|---|
| 1,743,997 | A * | 1/1930 | Davis et al. | 123/41.1 |
| 4,319,547 | A * | 3/1982 | Bierling | 123/41.29 |
| 4,381,736 | A * | 5/1983 | Hirayama | 123/41.1 |
| 4,539,942 | A | 9/1985 | Kobayashi et al. | |
| 4,744,336 | A * | 5/1988 | Miller | 123/41.1 |

(Continued)

FOREIGN PATENT DOCUMENTS

| | | | |
|---|---|---|---|
| DE | 10000299 | A1 | 7/2001 |
| DE | 102006010053 | A1 | 9/2007 |

(Continued)

*Primary Examiner* — Lindsay Low
*Assistant Examiner* — Long T Tran
(74) *Attorney, Agent, or Firm* — Gregory P. Brown; MacMillan, Sobanski & Todd, LLC

(57) ABSTRACT

An internal combustion engine cylinder head has a coolant jacket with a first supply opening and a first discharge opening. A cylinder block coolant jacket has a second supply opening and a second discharge opening. A coolant circuit connects the discharge openings to the supply openings via a recirculation line and a heat exchanger. A control unit has an inlet connected to a pump outlet, a first outlet connected to the first supply opening, a second outlet connected to the second supply opening, and a single setting element. The setting element has a first working position that opens up the first outlet and blocks the second outlet such that the coolant circuit is activated through the cylinder head and is deactivated through the cylinder block. The setting element has a second working position that opens up both the first outlet and the second outlet.

15 Claims, 1 Drawing Sheet

(56) References Cited

U.S. PATENT DOCUMENTS

| | | | | |
|---|---|---|---|---|
| 6,595,164 | B2 | 7/2003 | Kunze et al. | |
| 6,955,141 | B2 * | 10/2005 | Santanam et al. | 123/41.08 |
| 7,243,620 | B2 * | 7/2007 | Takahashi | 123/41.1 |
| 7,267,084 | B2 * | 9/2007 | Lutze et al. | 123/41.02 |
| 7,966,978 | B2 * | 6/2011 | Maehara et al. | 123/41.29 |
| 2006/0005790 | A1 * | 1/2006 | Braun et al. | 123/41.08 |
| 2009/0205590 | A1 * | 8/2009 | Vetrovec | 123/41.14 |
| 2011/0098883 | A1 * | 4/2011 | Eser et al. | 701/35 |
| 2011/0280705 | A1 * | 11/2011 | England et al. | 415/1 |
| 2011/0296834 | A1 * | 12/2011 | Kuhlbach et al. | 60/605.3 |
| 2012/0285401 | A1 * | 11/2012 | Quiring et al. | 123/41.08 |

FOREIGN PATENT DOCUMENTS

| | | | |
|---|---|---|---|
| DE | 102010023812 | A1 | 12/2011 |
| GB | 2245703 | A | 1/1992 |
| GB | 2247745 | A | 3/1992 |
| GB | 2270560 | A | 3/1994 |
| WO | 0112963 | A1 | 2/2001 |

* cited by examiner

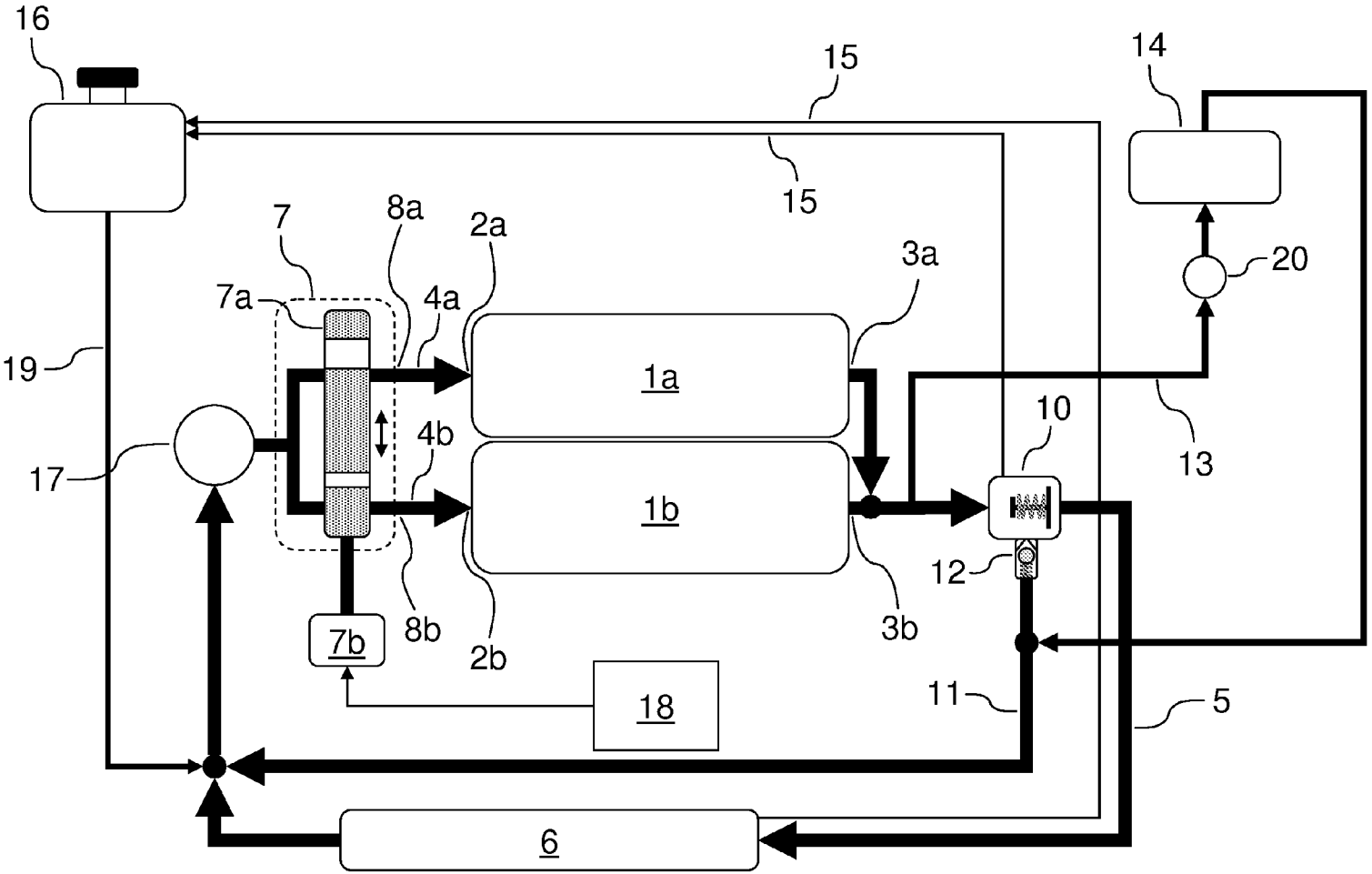
14
20
13
5
10
12
11
3a
3b
15
15
1a
1b
18
6
2a
2b
4a
4b
8a
8b
7b
7
7a
16
19
17

COOLANT CIRCUIT FOR INTERNAL COMBUSTION ENGINE WITH INLET-SIDE FLOW CONTROL

CROSS REFERENCE TO RELATED APPLICATIONS

This application claims priority to application 102012200746.6, filed in the German Patent and Trademark Office on Jan. 19, 2012, which is hereby incorporated by reference.

STATEMENT REGARDING FEDERALLY SPONSORED RESEARCH

Not Applicable.

BACKGROUND OF THE INVENTION

The present invention relates in general to cooling of internal combustion engines, and, more specifically, to a coolant circuit with flow into the engine being diverted between the cylinder head and the cylinder block according to the operating conditions of the engine.

The invention is an improvement to a liquid-cooled internal combustion engine having at least one cylinder head and one cylinder block, in which

- the at least one cylinder head is equipped with at least one integrated coolant jacket, said first coolant jacket having, at the inlet side, a first supply opening for the feed of coolant and, at the outlet side, a first discharge opening for the discharge of the coolant,
- the cylinder block is equipped with at least one integrated coolant jacket, said second coolant jacket having, at the inlet side, a second supply opening for the feed of coolant and, at the outlet side, a second discharge opening for the discharge of the coolant,
- to form a coolant circuit, the discharge openings can be connected to the supply openings via a recirculation line, a heat exchanger being provided in the recirculation line, and
- a pump for delivering coolant is provided at the inlet side.

An internal combustion engine of the above-stated type is used for example as a drive for a motor vehicle. Within the context of the present invention, the expression "internal combustion engine" encompasses diesel engines and spark-ignition engines and also hybrid internal combustion engines.

It is basically possible for the cooling arrangement of an internal combustion engine to take the form of an air-type cooling arrangement or a liquid-type cooling arrangement. On account of the higher heat capacity of liquids, it is possible for significantly greater quantities of heat to be dissipated using a liquid-type cooling arrangement than is possible using an air-type cooling arrangement. Therefore, internal combustion engines according to the prior art are ever more frequently being equipped with a liquid-type cooling arrangement, because the thermal loading of the engines is constantly increasing. Another reason for this is that internal combustion engines are increasingly being supercharged and—with the aim of obtaining the densest packaging possible—an ever greater number of components are being integrated into the cylinder head or cylinder block, as a result of which the thermal loading of the engines, that is to say of the internal combustion engines, is increasing. The exhaust manifold is increasingly being integrated into the cylinder head in order to be incorporated into a cooling arrangement provided in the cylinder head and in order that the manifold need not be produced from thermally highly loadable materials, which are expensive.

The formation of a liquid-type cooling arrangement necessitates that the cylinder head be equipped with at least one coolant jacket, that is to say necessitates the provision of coolant ducts which conduct the coolant through the cylinder head. The at least one coolant jacket is fed with coolant at the inlet side via a supply opening, which coolant, after flowing through the cylinder head, exits the coolant jacket at the outlet side via a discharge opening. The heat need not first be conducted to the cylinder head surface in order to be dissipated, as is the case in an air-type cooling arrangement, but rather is discharged to the coolant already in the interior of the cylinder head. Here, the coolant is delivered by means of a pump arranged in the coolant circuit, such that said coolant circulates. The heat which is discharged to the coolant is thereby discharged from the interior of the cylinder head via the discharge opening, and is extracted from the coolant again outside the cylinder head, for example by means of a heat exchanger and/or in some other way, for example by means of a heater in the passenger compartment of a vehicle.

Like the cylinder head, the cylinder block may also be equipped with one or more coolant jackets. The cylinder head is however the thermally more highly loaded component because, by contrast to the cylinder block, the head is provided with exhaust-gas-conducting lines, and the combustion chamber walls which are integrated in the head are exposed to hot exhaust gas for longer than the cylinder barrels or liners provided in the cylinder block. Furthermore, the cylinder head has a lower component mass than the block.

For coolant, a water-glycol mixture provided with additives is generally used. Compared to other coolants, water has the advantage that it is non-toxic, readily available and cheap, and furthermore has a very high heat capacity, for which reason water is suitable for the extraction and dissipation of very large amounts of heat, which is generally considered to be advantageous.

To form a coolant circuit, the outlet-side discharge openings via which coolant is discharged from the coolant jackets are connected via a recirculation line to the inlet-side supply openings which serve for the feed of coolant. Here, the recirculation line need not be a line in the physical sense but rather may also be integrated in portions into the cylinder head, the cylinder block or some other component. A heat exchanger is provided in the return line, which heat exchanger extracts heat from the coolant again.

It is not the aim and the purpose of a liquid-type cooling arrangement to extract the greatest possible amount of heat from the internal combustion engine under all operating conditions. In fact, what is sought is demand-dependent control of the liquid-type cooling arrangement, which aside from full load also makes allowance for the operating modes of the internal combustion engine in which it is more advantageous for less heat, or as little heat as possible, to be extracted from the internal combustion engine.

To reduce the friction losses and thus the fuel consumption of an internal combustion engine, fast heating of the engine oil, in particular after a cold start, may be expedient. Fast heating of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Known from the prior art are concepts by means of which the friction losses are reduced by means of fast heating of the engine oil. The oil may for example be actively heated by means of an external heating device. A heating device is however an additional consumer with regard to the usage of fuel, which opposes a reduction in fuel consumption. Other concepts provide that the engine oil heated during operation be stored in an insulated vessel and utilized upon a restart, wherein the oil heated during operation cannot be held at a high temperature for an unlimited amount of time. In a further concept, in the warm-up phase, a coolant-operated oil cooler is utilized, contrary to its intended purpose, for heating the oil, though this in turn assumes fast heating of the coolant.

Fast heating of the engine oil in order to reduce friction losses may basically also be abetted by means of fast heating of the internal combustion engine itself, which in turn is assisted, that is to say forced, by virtue of as little heat as possible being extracted from the internal combustion engine during the warm-up phase. In this respect, the warm-up phase of the internal combustion engine after a cold start is an example of an operating mode in which it is advantageous for as little heat as possible, preferably no heat, to be extracted from the internal combustion engine.

Control of the liquid-type cooling arrangement in which the extraction of heat after a cold start is reduced for the purpose of fast heating of the internal combustion engine may be realized through the use of a temperature-dependently self-controlling valve, often referred to as a thermostat valve. A thermostat valve of said type has a temperature-reactive element which is impinged on by coolant, wherein a line which leads through the valve is blocked or opened up—to a greater or lesser extent—at the element as a function of the coolant temperature.

In an internal combustion engine which has both a liquid-cooled cylinder head and also a liquid-cooled cylinder block, like the internal combustion engine which is the subject of the present invention, it is advantageous for the coolant throughput through the cylinder head and the cylinder block to be controlled independently of one another, in particular because the two components are thermally loaded to different degrees and exhibit different warm-up behavior. In this regard, it would be expedient for the coolant flow through the cylinder head and the coolant flow through the cylinder block to be controlled in each case by means of a dedicated thermostat valve.

U.S. Pat. No. 6,595,164 describes a cooling system for an internal combustion engine, which is cooled by means of liquid coolant, of a motor vehicle. To predefine the quantities of coolant which flow firstly through coolant ducts of a cylinder head and secondly through coolant ducts of a cylinder block, in each case dedicated thermostat valves are positioned downstream of the cylinder head and downstream of the cylinder block. Here, the thermostat valve of the cylinder head has a lower opening temperature than the thermostat valve of the cylinder block.

A disadvantage of the control as per U.S. Pat. No. 6,595,164 is that two shut-off elements, that is to say two thermostat valves, are required. This increases the costs of the control, the space requirement and the weight. A further disadvantage of the described control is that the circulation of the coolant in the cooling circuit, that is to say the flow of coolant, cannot be prevented in a targeted manner, not even after a cold start of the internal combustion engine. Therefore, after a cold start, coolant is conducted both through the cylinder head and also through the cylinder block, although the coolant flow through the cylinder block is reduced to a small leakage flow. A reduction of the dissipation of heat by convection is realized primarily through the bypassing of a coolant cooler arranged in the circuit, wherein the coolant conducted through the cylinder head is not conducted through the cooler in any switching state of the thermostat valves, and the coolant of the cylinder block is conducted through the cooler only when the opening temperature of the associated thermostat valve is reached.

By contrast, if, at least at the start of the warm-up phase, the coolant did not flow but rather was stationary in the lines and in the coolant jacket of the cylinder head and/or of the cylinder block, the warming of the coolant and the heating of the internal combustion engine would be further accelerated. Such control would additionally promote the warming of the engine oil and further reduce friction losses.

Furthermore, control of the liquid-type cooling arrangement is basically sought with which not only the circulating coolant quantity or the coolant throughput can be reduced after a cold start, but rather also the thermal management of the internal combustion engine heated up to operating temperature can be influenced.

A self-controlling thermostat valve with an invariant, component-specific operating temperature must be suitable for all load states and therefore have an opening temperature configured for high loads, which is comparatively low and leads to relatively low coolant temperatures even in part-load operation.

Different coolant temperatures would however be advantageous for different load states, because the heat transfer in the cylinder head is determined not only by the throughput coolant quantity but rather significantly also by the temperature difference between the component and coolant. A relatively high coolant temperature in part-load operation is thus equivalent to a small temperature difference between the coolant and the cylinder head or cylinder block. The result is reduced heat transfer at low and medium loads. This increases efficiency in part-load operation.

SUMMARY OF THE INVENTION

Against the background of that stated above, it is an object of the present invention to provide an internal combustion engine as per the preamble of claim 1, which is optimized with regard to the control of the cooling and which basically allows the thermal management of the internal combustion engine in the warm-up phase, and if appropriate the thermal management of the heated-up internal combustion engine, to be influenced. A further object is to provide a corresponding method by which the thermal management of the internal combustion engine is optimized.

The objects are achieved by internal combustion engine comprising a cylinder head having an integrated coolant jacket with a first supply opening at an inlet side for the feeding of coolant and a first discharge opening at an outlet side for the discharge of the coolant. A cylinder block has an integrated coolant jacket with a second supply opening at an inlet side for the feeding of the coolant and a second discharge opening at an outlet side for the discharge of the coolant. A coolant circuit connects the discharge openings to the supply openings via a recirculation line and a heat exchanger. A pump is coupled receiving the coolant from the recirculation line at a pump inlet and delivering the coolant to a pump outlet. A control unit is provided with an inlet connected to the pump outlet, a first outlet connected to the first supply opening, a second outlet connected to the second supply opening, and a single setting element. The setting element has a first working position that opens up the first outlet and blocks the second outlet such that the coolant circuit is activated through the cylinder head and is deactivated through the cylinder block. The setting element has a second working position that opens up both the first outlet and the second outlet such that the coolant circuit is activated through both the cylinder head and the cylinder block.

The internal combustion engine according to the invention has a control arrangement for the liquid-type cooling arrangement in which both the coolant flow through the cylinder head and also the coolant flow through the cylinder block is controlled at the inlet side by means of a single setting element. Within the context of the present invention, activation and deactivation are to be interpreted as meaning that, upon activation of the coolant circuit, the coolant circuit is opened up such that coolant can circulate in the circuit.

By contrast to the concepts known from the prior art, in which two shut-off elements in the form of thermostat valves are provided at the outlet side, it is the case according to the invention that a single setting element suffices for the control, according to demand, of the liquid-type cooling arrangement, or for the cooling of the internal combustion engine according to demand.

Since a single setting element is used instead of two thermostat valves, there is a resulting reduction in costs, weight and the space requirement of the control arrangement. The number of components is reduced, as a result of which the procurement costs and assembly costs are fundamentally reduced.

Whereas, in the prior art, use is made of self-controlling thermostat valves which are characterized by a fixed, that is to say invariant opening temperature, it is the case according to the invention that an actively controlled shut-off element is used—said active control being performed for example by means of an engine controller—such that it is basically possible to realize characteristic-map-controlled actuation of the setting element, and thus also a coolant temperature adapted to the present load state of the internal combustion engine, for example a higher coolant temperature at low loads than at high loads. By means of a setting element which is controlled by means of the engine controller, the flows of coolant through the cylinder head and the cylinder block and thus the extracted heat quantities can be adjusted, that is to say controlled, according to demand.

According to the invention, the setting element, when in a first working position, opens up the first outlet and blocks the second outlet, such that coolant flows through the cylinder head but not though the cylinder block. The first working position is suitable for the warm-up phase of the internal combustion engine, in which the fastest possible heating is sought. In the first working position, coolant flows through the cylinder head and the latter is thus continuously cooled, thereby allowing for the fact that the cylinder head is thermally particularly highly loaded and heats up relatively quickly. The first outlet can preferably be opened to a greater or lesser extent through adjustment of the setting element within the first working position, as a result of which the throughflow rate and thus the amount of heat extracted from the cylinder head are adjustable.

As a result of the movement of the setting element into the second working position, the second outlet of the control unit is additionally opened, such that the setting element, when in the second working position, opens up both the first outlet and also the second outlet of the control unit, and coolant flows through the cylinder head and the cylinder block. The second outlet can preferably be opened to a greater or lesser extent through adjustment of the setting element within the second working position, as a result of which the flow rate and thus the amount of heat extracted from the cylinder block are adjustable.

The adjustment of the setting element is preferably performed as a function of a determined cylinder head temperature $T_{cyl.-head}$ and/or cylinder block temperature $T_{cyl.-block}$. In this way, it is possible for both the cylinder head and also the cylinder block to be temperature-controlled or cooled according to demand.

With the internal combustion engine according to the invention, the first sub-object on which the invention is based is achieved as described above, that is to say an internal combustion engine is provided which is optimized with regard to the control of the cooling and which basically allows the thermal management of the internal combustion engine in the warm-up phase and the thermal management of the heated-up internal combustion engine to be influenced.

Further advantageous embodiments according to the subclaims will be discussed below. Here, it will in particular be made clear how the setting element is preferably actuated and which operating parameters of the internal combustion engine according to the invention are preferably used for this purpose.

Embodiments of the internal combustion engine are advantageous in which the setting element, when in a rest position, blocks the two outlets of the control unit such that the coolant circuit is deactivated both through the cylinder head and also through the cylinder block.

The provision of a further position, that is to say a rest position in which both outlets of the control unit are blocked, in addition to the two working positions makes it possible to also deactivate the cooling of the cylinder head, that is to say to, preferably completely, prevent the coolant flow through the cylinder head.

An internal combustion engine which is designed in this way has proven to be advantageous in particular during the warm-up phase directly after a cold start. After a period in which the vehicle has been at a standstill, that is to say upon a restart of the internal combustion engine, the cooling of the cylinder head and of the cylinder block remains deactivated as a result of the closure of both outlets. The coolant does not flow, but rather is stationary in the coolant jackets of the cylinder head and of the cylinder block. The warming of the coolant and the heating of the internal combustion engine are thus further accelerated. Such control also accelerates the warming of the engine oil, as a result of which the friction losses of the internal combustion engine are lowered and the fuel consumption of the internal combustion engine is further reduced.

Embodiments of the internal combustion engine are advantageous in which the setting element is continuously adjustable, in such a way that, in the first working position, the flow through the cylinder head can be adjusted, and/or in the second working position, the flow through the cylinder block can be adjusted.

It is basically possible for the liquid-type cooling arrangement of an internal combustion engine according to the invention to also be controlled in such a way that the setting element is designed to be switchable between different positions, and is then moved, that is to say switched, from one position into another position in stages, for example from the rest position into the first working position and from the first working position into the second working position.

As has already been stated, it is however particularly advantageous if the setting element is adjustable within a working position, and an outlet of the control unit can be opened to a greater or lesser extent. In this way, it is possible to regulate the coolant quantity which flows through the cylinder head and/or the cylinder block, and thus the amount of heat that is dissipated by means of the coolant.

Embodiments of the internal combustion engine are advantageous in which the setting element is a setting element which is controlled by means of an engine controller. Modern internal combustion engines generally have an engine controller, and it is therefore advantageous to utilize said controller for actuating or controlling the setting element.

In particular, the engine controller makes it possible for characteristic maps to be stored which can be used for characteristic-map-controlled cooling. It is then possible not only to reduce the coolant throughput after a cold start—with the aim of obtaining accelerated heating—but rather also to influence the thermal management of the internal combustion engine in a characteristic-map-specific manner. In particular, different coolant temperatures may be realized for different load states. It may be the case that operating parameters which can be used for the control of the cooling have already been determined for other purposes and are available or stored in the engine controller.

Embodiments of the internal combustion engine are advantageous in which the setting element is a slide. A slide, which is moved in translating (e.g., end-to-end) fashion during an adjustment, is particularly suitable for opening up and blocking more than one outlet, in particular the two outlets of the control unit. The drive for a slide of said type can be realized in a simple manner. Furthermore, a slide permits a continuously variable adjustment, that is to say allows an outlet to be opened or blocked to a greater or lesser extent.

Embodiments of the internal combustion engine are advantageous in which the setting element is adjustable as a function of a determined cylinder head temperature $T_{cyl.-head}$.

The above embodiment is characterized in that the temperature of a component which is to be limited or reduced within the context of the cooling of the internal combustion engine, that is to say the cylinder head temperature $T_{cyl.-head}$, is used as an input variable or regulating variable for the control or regulation of the setting element and hence of the cooling arrangement.

Embodiments of the internal combustion engine are advantageous in which the setting element is adjusted when the determined cylinder head temperature $T_{cyl.-head}$ exceeds a predetermined upper limit temperature $T_{head,up}$, where $T_{cyl.-head} \geq T_{head,up}$. Said limit temperature may be a characteristic-map-specific temperature, that is to say may vary for different load states.

Control arrangements are advantageous in which the setting element is adjusted only when the cylinder head temperature $T_{cyl.-head}$ exceeds the predetermined upper limit temperature $T_{head,up}$ and is higher than said upper limit temperature $T_{head,up}$ for a predetermined time period $\Delta t_{up}$.

The introduction of an additional condition is intended to prevent too frequent or hasty an actuation of the setting element if the cylinder head temperature $T_{cyl.-head}$ only briefly exceeds a predetermined upper limit temperature $T_{head,up}$ and then falls again or fluctuates around the predefined limit temperature, without this justifying an adjustment of the setting element.

The setting element may basically also be actuated as a function of some other operating parameter, for example as a function of the exhaust-gas temperature, which in the prior art is often used as an indication of an enrichment, which in turn serves for preventing overheating of the internal combustion engine, that is to say for limiting the cylinder head temperature $T_{cyl.-head}$.

In internal combustion engines in which the setting element is adjustable as a function of a determined cylinder head temperature $T_{cyl.-head}$, embodiments may be advantageous in which the temperature $T_{cyl.-head}$ of the cylinder head is determined by calculation.

The mathematical determination of the cylinder head temperature $T_{cyl.-head}$ is carried out for example by means of simulation, for which use is made of models known from the prior art, for example dynamic heat models and kinetic models for determining the reaction heat generated during the combustion. As input signals for the simulation, use is made preferably of operating parameters of the internal combustion engine which are already available, that is to say which have been determined for other purposes.

The simulation calculation is characterized in that no further components, in particular no sensors, need be provided in order to determine the temperature, which is expedient with regard to costs. It is however a disadvantage that the cylinder head temperature determined in this way is merely an estimated value, which can reduce the quality of the control or cooling.

Embodiments of the internal combustion engine are therefore also advantageous in which a sensor is provided for determining the cylinder head temperature $T_{cyl.-head}$.

The detection of the cylinder head temperature $T_{cyl.-head}$ by measurement is easily possible because the cylinder head exhibits relatively moderate temperatures even when the internal combustion engine has warmed up, such that no high demands are placed on the sensor. Furthermore, there are numerous possibilities, that is to say numerous locations, for the arrangement of a sensor.

To determine the cylinder head temperature $T_{cyl.-head}$ it is also possible to take into consideration a different component temperature, which is for example detected by measurement by means of a sensor or determined mathematically by means of simulation calculation. In said variant, the temperature of the cylinder head is determined indirectly—using a different temperature.

In a liquid-cooled internal combustion engine such as is the subject of the present invention, it is furthermore possible for the cylinder head temperature $T_{cyl.-head}$ to be determined, that is to say estimated, using the temperature of the coolant. For this purpose, too, a sensor may be provided in the cooling circuit or coolant jacket of the cylinder head.

Embodiments of the internal combustion engine are advantageous in which the setting element is adjustable as a function of a determined cylinder block temperature $T_{cyl.-block}$.

That which has been stated in conjunction with the cylinder head temperature $T_{cyl.-head}$ also applies analogously to the cylinder block temperature $T_{cyl.-block}$, such that reference is made to the corresponding explanations.

In this connection, embodiments of the internal combustion engine are also advantageous in which a sensor is provided for determining the cylinder block temperature $T_{cyl.-block}$. The cylinder block temperature $T_{cyl.-block}$ may be taken into consideration for determining the cylinder head temperature $T_{cyl.-head}$. Conversely, the cylinder head temperature $T_{cyl.-head}$ may be used for determining the cylinder block temperature $T_{cyl.-block}$.

Embodiments are advantageous in which the setting element is adjusted when the determined cylinder block temperature $T_{cyl.-block}$ exceeds a predetermined upper limit temperature$_{block,up}$, where $T_{cyl.-block} \geq T_{block,up}$. The limit temperature $T_{block,up}$ for the cylinder block is preferably higher than the limit temperature $T_{head,up}$ for the cylinder head, that is to say $T_{block,up} > T_{head,up}$.

Embodiments of the internal combustion engine are advantageous in which in the recirculation line there is provided, upstream of the heat exchanger, a self-controlling valve, which self-controlling valve has a temperature-reactive element impinged on by coolant and transfers the recirculation line in the direction of the closed position, and transfers a bypass line which bypasses the heat exchanger in the direction of the open position, if the coolant temperature $T_{coolant,valve}$ is lower than a predetermined coolant temperature $T_{threshold}$.

The thermostat valve ensures that coolant passes through the heat exchanger and is cooled only when this is necessary, that is to say if the coolant temperature $T_{coolant,valve}$ exceeds a predetermined coolant temperature $T_{threshold}$. It must be considered here in particular that, with regard to the efficiency of the internal combustion engine, it is basically advantageous for as little heat as possible to be extracted from the internal combustion engine or from the coolant. The thermostat valve adjusts in continuously variable fashion with constantly varying temperature, such that the flow cross sections of the recirculation line and of the bypass line are varied likewise in a continuously variable fashion between the closed position and the open position.

Embodiments of the internal combustion engine are also advantageous in which a proportional valve controlled by means of an engine controller is provided in the recirculation line upstream of the heat exchanger, which proportional valve adjusts or varies the flow cross section of the recirculation line, and the flow cross section of a bypass line which bypasses the heat exchanger, as a function of at least one operating parameter of the internal combustion engine, for example the coolant temperature $T_{coolant,valve}$. The lower the coolant temperature $T_{coolant,valve}$, the more coolant is conducted past the heat exchanger via the bypass line.

In this regard, embodiments of the internal combustion engine are advantageous in which a heating circuit is provided which comprises a feed line which branches off from the recirculation line upstream of the self-controlling valve, which opens into the bypass line and in which is arranged a heater which is operated with coolant. Heat can be extracted from the coolant, after it flows through the cylinder head or cylinder block, not only in a heat exchanger which serves as a cooler, but rather also through some other use.

In the present embodiment, a heater is provided which is operated with coolant and which utilizes the heated coolant to heat the air supplied to the passenger compartment of the vehicle, as a result of which the temperature of the coolant is reduced. In the feed line there may be provided a shut-off element which serves for the activation and deactivation of the heater.

Embodiments of the internal combustion engine are advantageous in which the control unit and the pump are accommodated in a common housing. The accommodation in a common housing yields inter alia effective packaging in the engine bay. The number of components is reduced, as a result of which the procurement costs and assembly costs are fundamentally reduced. The weight is also reduced. In this respect, the present embodiment advantageously assists in achieving the object on which the invention is based.

Embodiments of the internal combustion engine are advantageous in which the heat exchanger provided in the recirculation line is equipped with a fan. To provide an adequately large mass flow of air to the heat exchanger, and fundamentally assist the heat transfer, in all operating states, in particular when the motor vehicle is stationary and at only low vehicle speeds, it is advantageous for the heat exchanger to be equipped with a fan motor which drives a fan impeller, that is to say sets the latter in rotation. The fan motor is generally electrically operated and can preferably be controlled in a continuously variable manner with different loads or rotational speeds.

The object of specifying a method for operating a liquid-cooled internal combustion engine of an above-described type, is achieved by means of a method in which the setting element is controlled as a function of temperature. That which has already been stated with regard to the internal combustion engine according to the invention applies analogously to the method according to the invention. Reference is made to the description of the embodiments of the internal combustion engine, in particular to the method-related features and approaches discussed in this connection. Method variants are advantageous in which the setting element is controlled as a function of a determined coolant temperature $T_{coolant}$. Method variants are advantageous in particular in which the setting element is controlled as a function of a determined cylinder head temperature $T_{cyl.-head}$ and/or as a function of a determined cylinder block temperature $T_{cyl.-block}$.

Here, method variants are advantageous in which the setting element is moved from the first working position into the second working position when the cylinder block temperature $T_{cyl.-block}$ exceeds a predetermined temperature $T_{block,up}$.

Method variants are also advantageous in which the setting element is moved from a rest position, in which the two outlets of the control unit are blocked, into the first working position when the cylinder head temperature $T_{cyl.-head}$ exceeds a predetermined temperature $T_{head,up}$.

BRIEF DESCRIPTION OF THE DRAWINGS

The invention will be described in more detail below on the basis of an exemplary embodiment according to FIG. 1 which schematically shows a first embodiment of the internal combustion engine.

DETAILED DESCRIPTION OF PREFERRED EMBODIMENTS

FIG. 1 schematically shows a first embodiment of the internal combustion engine 1 having a cylinder head 1*a* and a cylinder block 1*b*. The internal combustion engine 1 is equipped with a liquid-type cooling arrangement, wherein the cylinder head 1*a* has a first integrated coolant jacket which has a first supply opening 2*a* at the inlet side for the feed of coolant and has a first discharge opening 3*a* at the outlet side for the discharge of the coolant. The cylinder block 1*b* likewise has an integrated coolant jacket. Said second coolant jacket has a second supply opening 2*b* at the inlet side for the feed of coolant and has a second discharge opening 3*b* at the outlet side for the discharge of the coolant.

To form a coolant circuit, the outlet-side discharge openings 3*a*, 3*b* can be connected to the inlet-side supply openings 2*a*, 2*b* via a recirculation line 5, wherein a heat exchanger 6 (such as a radiator) is arranged in the recirculation line 5. A pump 17 for delivering the coolant is provided at the inlet side. Pump 17 can be driven either mechanically or electrically.

For the control of the coolant flows through the cylinder head 1*a* and the cylinder block 1*b*, a control unit 7 charged with coolant and having a single setting element 7*a* in the form of a slide 7*a* is provided at the inlet side. The control unit 7 has two outlets 8*a*, 8*b*, wherein a first outlet 8*a* is connected via a line portion 4*a* to the first supply opening 2*a* of the first coolant jacket, and a second outlet 8*b* is connected via a line portion 4*b* to the second supply opening 2*b* of the second coolant jacket.

The slide which serves as a setting element 7*a* is displaceable in translating fashion and is driven by means of an electric motor 7*b*, and, by means of an engine controller 18, is actuated, that is to say controlled, such that the flow through the cylinder head 1*a* and the flow through the cylinder block 1*b* can be adjusted, or are variable.

The setting element 7*a*, when in a rest position, blocks the two outlets 8*a*, 8*b* of the control unit 7, such that the coolant flow is interrupted both through the cylinder head 1*a* and also through the cylinder block 1*b*. By means of a movement of the slide 7*a* into a first working position, the first outlet 8*a*, which is connected to the coolant jacket of the cylinder head 1*a* via line portion 4*a*, is opened up, while the second outlet 8*b* remains blocked. The coolant circuit through the cylinder head 1*a* is thus activated, while the coolant circuit through the cylinder block 1*b* remains deactivated. Further sliding of the setting element 7*a* into a second working position also opens up the second outlet 8*b*, such that the coolant circuit through the cylinder block 1*b* is additionally activated.

A self-controlling valve 10 is arranged in the recirculation line 5 upstream of the heat exchanger 6, which self-controlling valve has a temperature-reactive element which is impinged on by coolant. Said thermostat valve 10 blocks the recirculation line 5 and opens up a bypass line 11, which bypasses the heat exchanger 6, if the coolant temperature $T_{coolant,valve}$ is lower than a predetermined coolant temperature $T_{threshold}$ and it is not necessary for heat to be additionally extracted from the coolant in the heat exchanger 6. By contrast, if the predefined coolant temperature $T_{threshold}$ is exceeded, the thermostat valve 10 opens the recirculation line 5. The bypass line 11, in which an overpressure valve 12 is additionally arranged, opens into the recirculation line 5 again at the inlet side.

To form a heating circuit, a feed line 13 branches off at the outlet side from the recirculation line 5 upstream of the thermostat valve 10, which feed line opens downstream into the bypass line 11 again. In the feed line 13, there is arranged a heater 14 which is operated with coolant and by means of which the air supplied to the passenger compartment of a vehicle can be heated. The heater 14 can be deactivated, that is to say shut off, by means of valve 20.

Ventilation lines 15 connect the recirculation line 5 and the heat exchanger 6 to a ventilation tank 16. The ventilation tank 16 itself is connected via a return line 19 at the inlet side to the recirculation line 5.

What is claimed is:

1. An internal combustion engine comprising:

a cylinder head having an integrated coolant jacket with a first supply opening at an inlet side for the feeding of coolant and a first discharge opening at an outlet side for the discharge of the coolant;

a cylinder block having an integrated coolant jacket with a second supply opening at an inlet side for the feeding of the coolant and a second discharge opening at an outlet side for the discharge of the coolant;

a coolant circuit connecting the discharge openings to the supply openings via a recirculation line and a heat exchanger;

a pump coupled to the coolant circuit, receiving the coolant from the recirculation line at a pump inlet and delivering the coolant to a pump outlet; and a control unit having an inlet connected to the pump outlet, a first outlet connected to the first supply opening, a second outlet connected to the second supply opening, and a single setting element, wherein the setting element has a first working position that opens up the first outlet and blocks the second outlet such that the coolant circuit is activated through the cylinder head and is deactivated through the cylinder block, and wherein the setting element has a second working position that opens up both the first outlet and the second outlet such that the coolant circuit is activated through both the cylinder head and the cylinder block, wherein the setting element further has a rest position that blocks both outlets of the control unit, such that the coolant circuit is deactivated both through the cylinder head and the cylinder block.

2. The internal combustion engine of claim 1 wherein the setting element is continuously adjustable in such a way that the flow through the cylinder head can be adjusted while in the first working position, and the flow through the cylinder block can be adjusted while in the second working position.

3. The internal combustion engine of claim 1 wherein the setting element is controlled by an engine controller as a function of a determined cylinder head temperature $T_{cyl.-head}$.

4. The internal combustion engine of claim 1 wherein the setting element is controlled by an engine controller as a function of a determined cylinder block temperature $T_{cyl.-block}$.

5. The internal combustion engine of claim 1 wherein the setting element is comprised of a slide.

6. The internal combustion engine of claim 1 further comprising:

a self-controlling valve upstream of the heat exchanger having a temperature-reactive element impinged on by the coolant and arranged to bypass the heat exchanger if the coolant temperature $T_{coolant,valve}$ is lower than a predetermined coolant temperature $T_{threshold}$.

7. The internal combustion engine of claim 6 further comprising a heating circuit comprised of:

a feed line which branches off from the recirculation line upstream of the self-controlling valve and which opens into the bypass line; and a heater for heating the coolant.

8. The internal combustion engine of claim 1 further comprising:

a proportional valve upstream of the heat exchanger; and an engine controller for adjusting the proportional valve to control a flow cross section of the recirculation line and a flow cross section of a bypass line which bypasses the heat exchanger, as a function of at least one operating parameter of the internal combustion engine.

9. The internal combustion engine of claim 1 wherein the control unit and the pump are accommodated in a common housing.

10. The internal combustion engine of claim 1 further comprising an engine controller coupled to the control unit for positioning the setting element as a function of a determined coolant temperature $T_{coolant}$.

11. The internal combustion engine of claim 1 further comprising an engine controller coupled to the control unit for positioning the setting element as a function of a determined cylinder head temperature $T_{cyl.-head}$.

12. The internal combustion engine of claim 1 further comprising an engine controller coupled to the control unit for positioning the setting element as a function of a determined cylinder block temperature $T_{cyl.-block}$.

13. The internal combustion engine of claim 1 further comprising an engine controller coupled to the control unit for moving the setting element from the first working position into the second working position when the cylinder block temperature $T_{cyl.-block}$ exceeds a predetermined temperature $T_{block,up}$.

14. The internal combustion engine of claim 1 further comprising an engine controller coupled to the control unit for moving the setting element from the rest position in which the two outlets of the control unit are blocked into the first working position when the cylinder head temperature $T_{cyl.-head}$ exceeds a predetermined temperature $T_{head,up}$.

15. An engine comprising:

a head;

a block;

a coolant circuit connecting the head and block via a recirculation line, pump, and radiator;

a valve with a first position activating flow through the head only, a second position activating flow through the head and block, and a rest position blocking flow to the head and block, wherein the valve moves from rest position to the first position when a head temperature exceeds a predetermined temperature.

* * * * *